United States Patent [19]

Trowbridge

[11] 4,235,040

[45] Nov. 25, 1980

[54] MODEL AIRPLANE

[76] Inventor: Howard W. Trowbridge, Box 13, Vavenby, British Columbia, Canada, V0E 3A0

[21] Appl. No.: 11,760

[22] Filed: Feb. 12, 1979

[51] Int. Cl.[3] ..... A63H 27/00; A63B 65/00

[52] U.S. Cl. ..... 46/79; 273/426

[58] Field of Search ..... 46/79, 80, 81, 76 R; 244/92; 273/426

[56] References Cited

U.S. PATENT DOCUMENTS

| | | | |
|---|---|---|---|
| D. 162,707 | 4/1951 | Benson | 46/79 |
| 1,245,279 | 11/1917 | Shrum | 273/426 |
| 1,295,537 | 2/1919 | Lorentzen | 46/81 |
| 2,231,226 | 2/1941 | Schwarzmayr | 244/92 |
| 2,298,425 | 10/1942 | Shaffer | 273/426 |
| 2,599,484 | 6/1952 | Rhodes | 46/76 R |
| 3,187,460 | 6/1965 | Robertson | 46/79 |
| 3,224,138 | 12/1965 | Shapiro | 46/79 |

*Primary Examiner*—F. Barry Shay
*Assistant Examiner*—John J. Wilson
*Attorney, Agent, or Firm*—Townsend and Townsend

[57] ABSTRACT

A model airplane comprises a flat wing and a member connected to the wing midway between the wing-tips and near the back of the wing which extends away from the top surface of the wing. A freewheeling vane is connected to the back of the member and spaced-apart from the top surface of the wing.

7 Claims, 4 Drawing Figures

1
2
4
6
8
10
12
14
16
18
22
24
28
30
32
38
41
42
44
46

1
2
4
6
8
10
12
16
18
22
24
28
30
32
38
41
42

1
2
4
6
10
12
14
16
18
22
24
28
30
32
38
41
42

1
2
4
6
8
10
12
14
16
17
18
20
22
24
26
28
30
32
34
36
38
40
41
42
43

MODEL AIRPLANE

BACKGROUND OF THE INVENTION

This invention relates to a model airplane.

Model airplanes, more particularly small hand-tossed gliders have been a popular amusement for many years. These models are made from many materials such as balsa wood, foam plastic or even paper. Generally, they somewhat resemble an actual airplane and have a wing, a tail and some form of fuselage. However, many unusual shapes have been employed which bear little resemblance to an actual aircraft.

One particular goal has been to develop a small glider which can be tossed by a person and will reliably follow a loop and return to the person at the end of the flight. Of course, it is well known that certain Australian boomerangs will return to the place from which they are tossed. However, this requires a certain skill which is not easily acquired by some individuals. Additionally, the loop followed by the boomerang is normally too large for most interior use. There is also little resemblance between a boomerang and an airplane, so the enthusiasm many people have for model airplanes may be lacking.

SUMMARY OF THE INVENTION

According to the invention, a model airplane comprises a flat wing with two wing-tips, a front, a back and a top surface. A member is connected to the wing generally midway between the wing-tips, near the back of the wing and extending away from the top surface. a freewheeling vane is spaced-apart from the top surface of the wing and is connected to the member near the back of the wing.

Preferably, the model airplane is adapted to glide in a direction when propelled towards the direction with the front of the wing facing the direction and then released. The vane member is rotatable by air, about an axis generally parallel to the direction, as the plane glides, thereby lifting the front of the wing so the wing planes the air.

A model airplane according to an embodiment of the invention is inherently acrobatic and can fly in a tight loop to return to the owner. Most people can acquire this skill after a few practice attempts.

It should be noted that the vane, or propeller, is not included merely for the sake of appearance. The model airplane will not fly in a loop without the propeller. The propeller applies a back pressure, keeping the plane in a turn and also stabilizes the flight. Such a model airplane is primarily intended for indoor use.

In drawings which illustrate embodiments of the invention:

DESCRIPTION OF THE PREFERRED EMBODIMENTS

Figure 3:
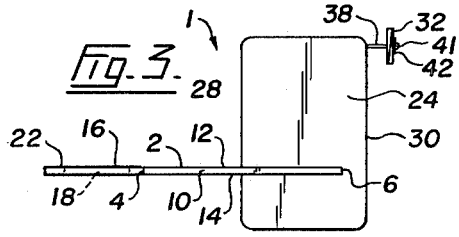
FIG. 3 is a side elevational view of the model airplane.
Figure 4:
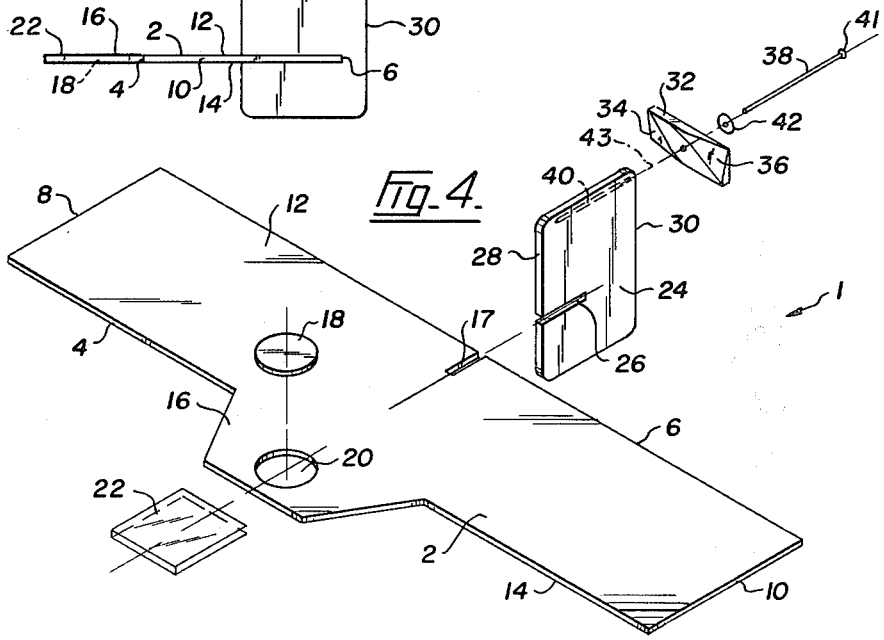
FIG. 4 is an exploded isometric view from the front of the model airplane.

The model airplane 1, shown in the drawings, includes a flat, rectangular wing 2 with a front or leading edge 4 and a back or trailing edge 6. The wing 2 has a right wing tip 8 and a left wing 10 and is elongate in the direction between the wing-tips. As shown best in FIG. 3, the wing is uniformly flat, having no airfoil. The wing has a flat top surface 12 and a corresponding bottom surface 14. A trapezoidal projection 16 extends forwardly from the front 4 of the wing midway between the wing-tips 8 and 10. A narrow slot 17 extends forwardly from the back 6 of the wing 2 as seen in FIG. 4. The entire wing 2, including the forward projections 16, comprises a single piece of expanded polystyrene. Of course, other suitable light-weight materials could be substituted.

A weight comprising a penny 18 is fitted within an equivalently sized aperture 20 in the forward projection 16. The penny 18 is held in position by a piece of adhesive cellophane tape 22.

Figure 1:
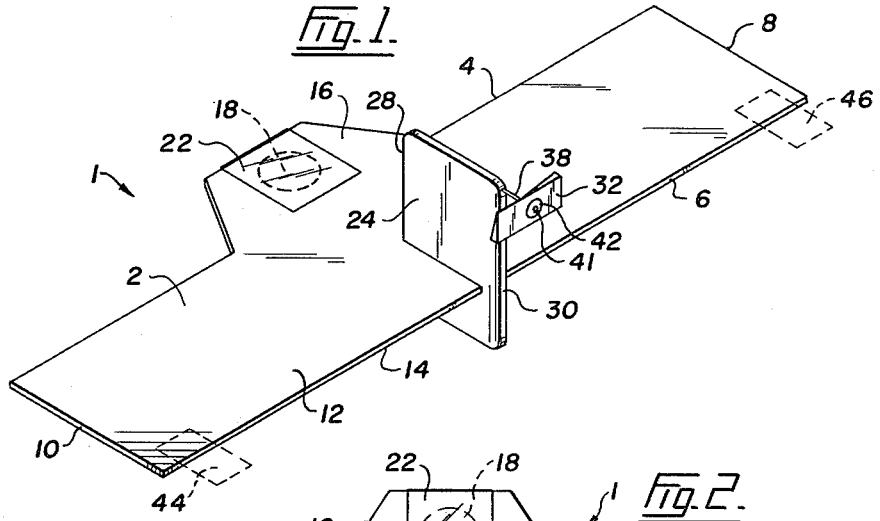
FIG. 1 is an isometric view, from the rear, of a model airplane according to an embodiment of the invention.
Figure 2:
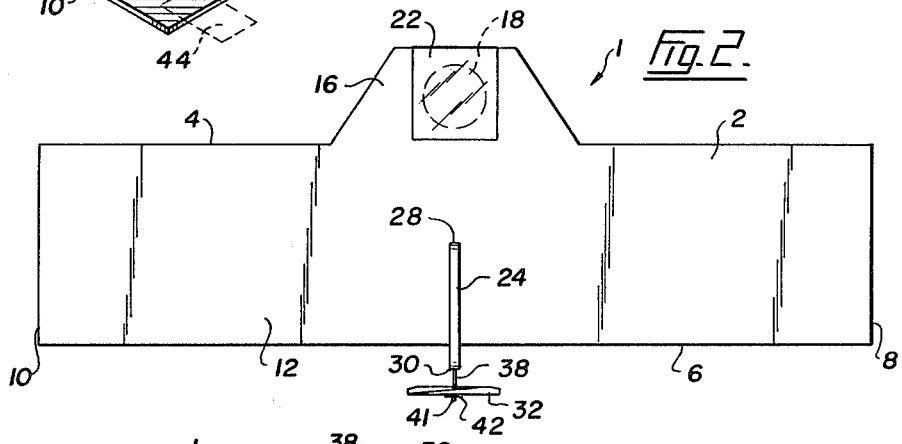
FIG. 2 is a plan view of the model airplane shown in FIG. 1.

The airplane 1 also includes a vertical stabilizer member 24. Member 24 is rectangular in shape and includes a narrow slot 26 extending inwardly from the front edge 28 thereof. Stabilizer member 24 is connected to the wing 2 by pressing the slot 26 of the stabilizer member over the slot 17 of the wing. In this position, the stabilizer member is perpendicular to the wing 2 and extends upwardly away from the top surface 12 of the wing. The stabilizer member 24 comprises a single piece of flat expanded polystyrene similar to the wing. Again, other suitable light-weight materials could be substituted. When connected to the wing as shown in FIGS. 1 and 3, the stabilizer member 24 is elongate in the direction along its front edge 28 and rear edge 30, perpendicular to the top surface 12 of the wing.

The airplane 1 has a propeller-like, freewheeling vane 32 made of a suitable light-weight material, in this case expanded polystyrene foam. The van 32 is in the shape of an elogate rectangle with two angled surfaces 34 and 36 which provide a relatively small pitch of approximately 3°. The vane 32 is spaced-apart a distance above the top surface 12 of the wing 2 and is rotatably connected to the rear edge 30 of the stabilizer member 24 by means of a nylon shaft 38. The shaft 38 is tightly received within an aperture 40 in the stabilizer 24 which is produced by simply forcing the shaft into the foam plastic stabilizer. The exposed end of the shaft 38 is fused to produce an enlargedtip 41 to retain the vane 32 and a small plastic washer 42 reduces the friction to aid in the freewheeling of the vane. Shaft 38 is positioned along an axis 43 which is generally parallel to the direction of flight of the model airplane.

In order to fly the model airplane, the stabilizer member 24 is grasped below the bottom surface 14 of the wing between the thumb and the middle finger. The index finger extends along the rear edge 30 of the stabilizer member away from the top surface 12 of the wing. For a right turn, the wing is held generally vertical with the right wing-tip 8 pointing downwardly. A small piece of cellophane tape 44 applied to the wing near the back 6 and the left wing-tip 10 aids the right turn. With the front 4 of the wing facing a given direction, the plane is propelled forward, mainly by the force of the index finger, and the plane will glide in the propelled direction, turning to the right. After completing a right loop, the plane will return to the person who threw it. As the plane moves through the air, the vane 32 is rotated by the air and lifts the front 4 of the wing, so the wing planes the air and makes the right turn as described.

To make a left turn, the plane is held in a similar manner, but the left wing-tip 10 points downwardly. A small piece of cellophane tape 46 applied to the wing near the right wing-tip 8 and the back 6 help with the left turn.

What I claim is:

1. A model airplane comprising:

a flat wing with two wing-tips, a front, a back and a top surface;

a flat stabilizer connected to the wings generally midway between the wing-tips, the stabilizer extending perpendicularly away from the top surface of the wing and extending from near the back of the wing towards the front of the wing and having a rear edge; and a freewheeling vane connected to the rear edge of the stabilizer and spaced-apart from the top surface of the wing, the vane being rotatable by air about an axis which is generally parallel to the direction of flight of the model airplane, whereby, after the model airplane is tossed in said direction, the vane lifts the front of the wing so the wing planes the air and the airplane flies in a loop, returning to a person who threw it.

2. A model airplane as claimed in claim 1, the wing being uniformly flat.

3. A model airplane as claimed in claim 2, the stabilizer comprising a rectangle, elongate in a direction perpendicular to the top surface of the wing.

4. A model airplane as claimed in claim 3, the wing being elongate in a dimension extending between the wing-tips.

5. A model airplane as claimed in claim 1 or claim 4, the wing and stabilizer comprising expanded plastic foam.

6. A model airplane as claimed in claim 5, the vane being propeller-like with a relatively small pitch.

7. A model airplane as claimed in claim 1 comprising a weight connected to a projection extending forwardly from the front of the wing.

* * * * *